US008835833B2

(12) United States Patent
Du et al.

(10) Patent No.: US 8,835,833 B2
(45) Date of Patent: Sep. 16, 2014

(54) TWO-DIMENSIONAL MAGNETO-OPTICAL TRAP FOR NEUTRAL ATOMS

(75) Inventors: Shengwang Du, Hong Kong (CN); Shanchao Zhang, Hong Kong (CN); Shuyu Zhou, Shanghai (CN); Guang Yu Yin, Mountain View, CA (US); Chinmay Belthangady, Cambridge, MA (US)

(73) Assignees: The Hong Kong University of Science and Technology, Hong Kong (CN); The Board of Trustees of the Leland Stanford Junior University, Palto Alto, CA (US)

( * ) Notice: Subject to any disclaimer, the term of this patent is extended or adjusted under 35 U.S.C. 154(b) by 35 days.

(21) Appl. No.: 13/598,129

(22) Filed: Aug. 29, 2012

(65) Prior Publication Data

US 2013/0048846 A1 Feb. 28, 2013

Related U.S. Application Data

(60) Provisional application No. 61/573,081, filed on Aug. 29, 2011, provisional application No. 61/634,086, filed on Feb. 23, 2012.

(51) Int. Cl.
*H05H 3/00* (2006.01)
*G21K 1/00* (2006.01)

(52) U.S. Cl.
CPC ..... *G21K 1/006* (2013.01)
USPC ..... 250/251

(58) Field of Classification Search
CPC ..... G21K 1/006
USPC ..... 250/251
See application file for complete search history.

(56) References Cited

U.S. PATENT DOCUMENTS

| | | | | |
|---|---|---|---|---|
| 7,816,643 | B2 | 10/2010 | Hyodo | |
| 2005/0199871 | A1 | 9/2005 | Anderson et al. | |
| 2006/0043316 | A1* | 3/2006 | Liebert et al. | 250/492.21 |

(Continued)

OTHER PUBLICATIONS

Chapovsky, 'Spectral Characteristics of Cold Rubidium Atoms in a Dark Magneto-Optical Trap' Jun. 26, 2006, Journal of Experimental and Theoretical Physics, vol. 103, No. 5, pp. 711-719.*

(Continued)

*Primary Examiner* — Nicole Ippolito
*Assistant Examiner* — Eliza Osenbaugh-Stewart
(74) *Attorney, Agent, or Firm* — Nath, Goldberg & Meyer; Jerald L. Meyer; Stanley N. Protigal

(57) ABSTRACT

A two-dimensional (2D) magneto-optical trap (MOT) for alkali neutral atoms establishes a zero magnetic field along the longitudinal symmetry axis. Two of three pairs of trapping laser beams do not follow the symmetry axes of the quadruple magnetic field and are aligned with a large non-zero degree angles to the longitudinal axis. In a dark-line 2D MOT configuration, there are two orthogonal repumping beams. In each repumping beam, an opaque line is imaged to the longitudinal axis, and the overlap of these two line images creates a dark line volume in the longitudinal axis where there is no repumping light. The zero magnetic field along the longitudinal axis allows the cold atoms maintain a long ground-state coherence time without switching off the MOT magnetic field, which makes it possible to operate the MOT at a high repetition rate and a high duty cycle.

15 Claims, 13 Drawing Sheets

(56) References Cited

U.S. PATENT DOCUMENTS

| | | | | |
|---|---|---|---|---|
| 2009/0272887 | A1* | 11/2009 | Fatemi et al. | 250/251 |
| 2010/0200739 | A1* | 8/2010 | Anderson et al. | 250/251 |
| 2011/0290991 | A1* | 12/2011 | Booth et al. | 250/251 |

OTHER PUBLICATIONS

Kuzmich, et al., "Generation of nonclassical photon pairs for scalable quantum communication with atomic ensembles," Nature, (2003), vol. 423, pp. 731-734.

Dieckmann, et al., "Two-dimensional magneto-optical trap as a source of slow atoms," Physical Review A, (1998), vol. 58, No. 5, pp. 3891-3895.

Tiecke, et al., "High-flux two-dimensional magneto-optical-trap source for cold lithium atoms," Physical Review A, (2009), vol. 80, pp. 013409-1-013409-12.

Raab, et al., "Trapping of Neutral Sodium Atoms with Radiation Pressure," Physical Review Letters, (1987), vol. 59, No. 23, pp. 2631-2634.

Zhang, et al., "A dark-line two-dimensional magneto-optical trap of 85Rb atoms with high optical depth," Review of Scientific Instruments, (2012), vol. 83, pp. 073102-1-073102-7.

* cited by examiner

TWO-DIMENSIONAL MAGNETO-OPTICAL TRAP FOR NEUTRAL ATOMS

RELATED APPLICATIONS

The present Patent Application claims priority to Provisional Patent Application No. 61/573,081 filed Aug. 29, 2011, which is assigned to the assignee hereof and assigned to at least one of the inventors hereof, and Provisional Patent Application No. 61/634,086 filed Feb. 23, 2012, which are assigned to the assignee hereof and filed by at the inventors hereof, both of which are incorporated by reference herein.

STATEMENT OF GOVERNMENT INTEREST

This invention was made with Government support under contracts FA9550-04-1-0442and FA9550-07-1-0009 awarded by the Air Force Office of Scientific Research. The United States Government has certain rights in this invention.

BACKGROUND

1. Field

The present disclosure relates to a neutral atom trapping device with high optical depth for quantum optics experiments.

2. Background

Since laser cooling and trapping was developed in 1980's [E. L. Raab, M. Prentiss, A. Cable, S. Chu, and D. E. Pritchard, Phys. Rev. Lett. 59, 2631 (1987)] that led to the Nobel Prize in Physics in 1997, the magneto-optical trap (MOT) has been widely applied and implemented to provide cold atom sources for scientific researches in the field of atomic physics and quantum optics. Many cold atom devices have been invented for possible applications in atomic sensors and some of them have been commercialized [See ColdQuanta Inc; D. Z. Anderson and J. G. J. Reichel, US Patent 2005/0199871; D. Z. Anderson et al, US Patent 2010/0200739; M. Hyodo, U.S. Pat. No. 7,816,643 B2]. The most commonly used cold atom device is the three-dimensional (3D) MOT with a configuration of six trapping laser beams and a 3D quadrupole magnetic field where the cold atoms are trapped at the position of zero magnetic field spherically. In that configuration, there is only one point of zero magnetic field and the atoms experience magnetic gradients along every direction. Therefore, for experiments and applications which require long atomic coherence time, such as electromagnetically induced transparency (EIT), atomic quantum memory, and single-photon generation, the magnetic field must be switched off before the experimental time window [A. Kuzmich, W. P. Bowen, A. D. Boozer, A. Boca, C. W. Chou, L.-M. Duan, and H. J. Kimble, Nature 423, 731 (2003).]. This significantly adds complicity in the controlling system and prevents the experimental data collected from a high repetition rate because it always takes time to switch off the current in a magnetic coil due to the inductance. The quantum optics and photon counting experiments based on the 3D MOT are typically time consuming.

One approach changes a 3D quadrupole magnetic field to a 2D quadrupole magnetic field with a line of zero magnetic fields. This is called a 2D MOT where the cold atoms are trapped in the zero magnetic field line along the longitudinal symmetry axis. There are two configurations in the conventional 2D MOT devices. In the first configuration, there are only 4 trapping laser beams transmitted perpendicularly to the longitudinal axis [T. G. Tiecke, S. D. Gensemer, A. Ludewig, and J. T. M. Walraven, Phys. Rev. A 80, 013409 (2009)]. As a result, the cooling and trapping occur only two-dimensionally and there is no cooling and trapping along the longitudinal symmetry axis where the atoms are free to move. In the second configuration, two more counter-propagating trapping laser beams are added along the longitudinal axis to provide the additional cooling in the third dimension [K. Dieckmann, R. J. C. Spreeuw, M. Weidemuller, and J. T. M. Walraven, Phys. Rev. A 58, 3891 (1998)]. In that setup, the optical accesses along the longitudinal symmetry axis are blocked or shared by the two trapping beams along that direction. The conventional 2D M High optical depth (OD) is sought for much quantum optics research [A. V. Gorshkov, A. Andre, M. Fleischhauer, A. S. Sorensen, and M. D. Lukin, Phys. Rev. Lett. 98, 123601 (2007)], but in the traditional MOT optical configuration high OD is commonly obtained by increasing the MOT size where more cold atoms can be obtained in the cloud. But the MOT size is usually determined by the MOT laser beam size which is limited by the total laser power. Another way to improve the OD is increasing the atomic density in the cloud using a dark-spot configuration [W. Ketterle, K. B. Davis, M. A. Joffe, A. Martin and D. E. Pritchard, Phys. Rev. Lett. 70, 2253(1993)], but the magnetic field gradient is often required to switched off for applications. Also, in conventional 2D MOTs, there is a limitation for optical access due to its geometry and the OD may need to be further improved.

SUMMARY

A two-dimensional (2D) magneto-optical trap (MOT) comprises an atom source, a bakeable ultra-high vacuum cell, a two-dimensional quadrupole magnetic field, at least 6 trapping laser beams, and at least one repumping laser beams. In the dark-line 2D MOT configuration, we use two orthogonal repumping laser beams with a dark line crossover at center along the longitudinal axis. At least two pairs trapping laser beams do not follow the symmetry axis of the quadrupole magnetic field: they are aligned with non-zero degree angles relative to the longitudinal axis of the MOT.

BRIEF DESCRIPTION OF THE DRAWINGS

FIG. 3A depicts the octagonal glass cell with a transition tube. FIG. 3B depicts the octagonal glass cell and its arrangement with the magnetic coil and six trapping laser beams.

FIG. 4A depicts the rectangle glass cell. FIG. 4B depicts the glass cell and its arrangement with the magnetic coil and the six trapping laser beams.

FIG. 10A is a 3D view. FIGS. 10B and C are cross section views in x-y and y-z planes, respectively.

FIG. 11A depicts a magnetic coil set with many turns, and FIG. 11B depicts a permanent magnet set. The inset inside FIG. 11B shows the alignment of the 4 magnets in x-y plane.

FIG. 12A depicts the involved atomic energy level diagram in $^{85}$Rb D1 lines. FIG. 12B depicts the optical setup. FIG. 12C depicts the MOT and EIT measurement timing.

FIG. 13A depicts a probe absorption spectrum profile in a two-level system and in an EIT system. FIG. 13B depicts the measured OD as a function of the current of two dispensers in the 2D MOT without the dark line, the dark-line 2D MOT without the depopular beam and the dark-line 2D MOT with the depopular beam.

DETAILED DESCRIPTION

Overview

Figure 1:
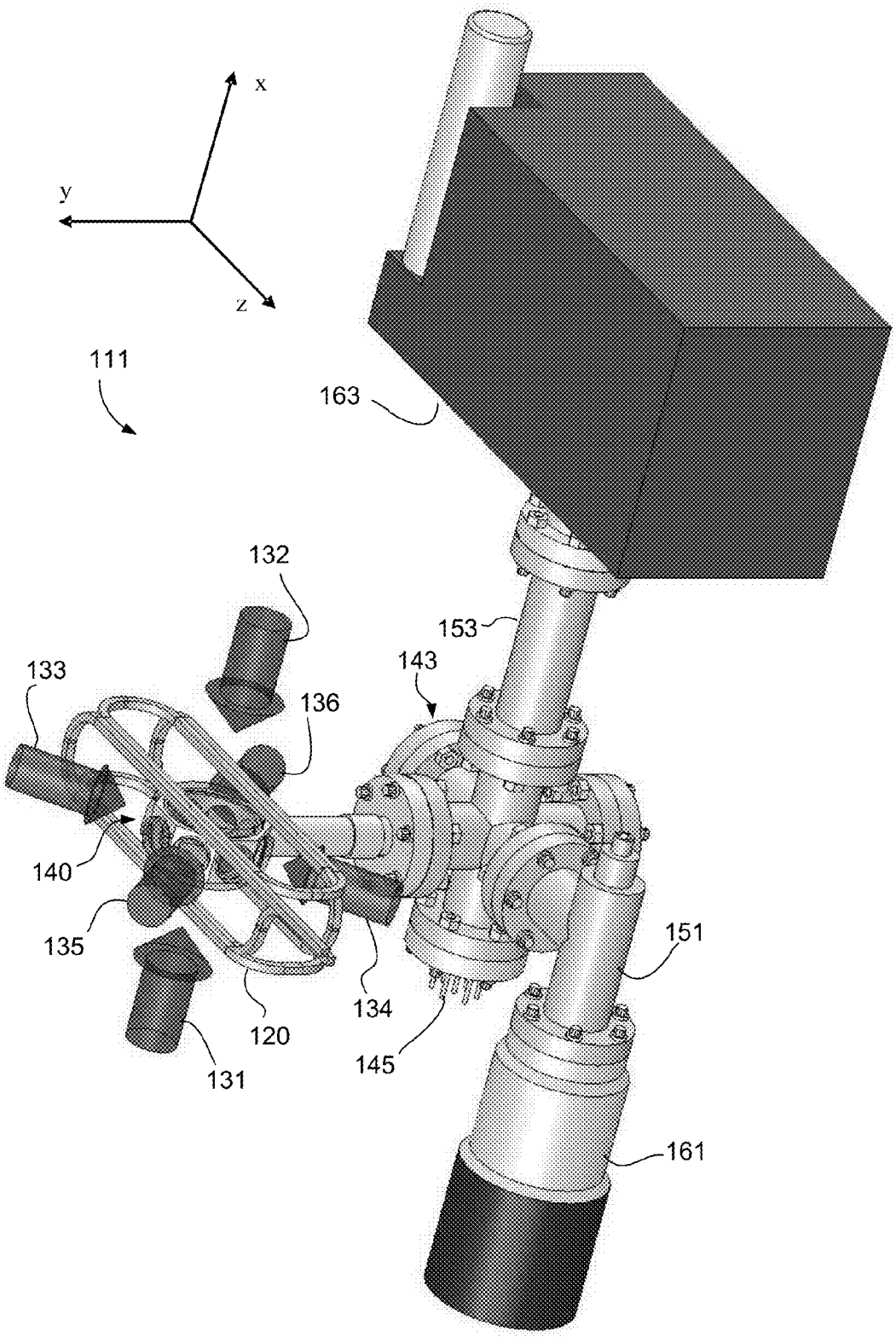
FIG. 1 is a schematic illustration of a 2D MOT apparatus with an octagonal cell and magnetic coil, showing laser beam alignment.

A two-dimensional magneto-optical trap (2D MOT) system uses six trapping laser beams. The 2D MOT has no trapping beam in the symmetry axis so that it allows full optical access to further experiments. For conducting quantum optics experiments, there is no need to switch off the magnetic field for maintaining long atomic coherence time. In the following description, for the purpose of illustration, $^{85}$Rb atoms are taken as a demonstrated example. The principles described here can be applied to other neutral atoms.

In one embodiment, the 2D MOT apparatus comprises a compact bakeable ultra-high vacuum cell, a single hollow-core wire magnetic coil, and an optical alignment with six trapping laser beams. The bakeable ultra-high vacuum cell comprises a glass cell with optical quality, a six-way all-metal cross chamber, an atomic dispenser source, an ion pump, and a turbo molecular pump. The glass cellcan take either an octagonal or rectangular shape. The magnetic coil, taking a single-wire design, produces a 2D quadrupole magnetic field with a zero magnetic field line along the longitudinal axis.

For the trapping laser, a six-beam configuration is used. Two counter-propagating trapping laser beams are transmitted perpendicularly to the longitudinal symmetry axis, and the other four (two counter-propagating pairs) trapping laser beams are aligned with a 45° angle to the symmetry axis. The cold atoms are trapped along the symmetry axis. Because there is no trapping beam in the symmetry axis, the device provides a full optical access along the symmetry axis. As a result of the six-beam configuration, a three-dimensional cooling effect is achieved, so the cooling effect of the MOT occurs in all directions though the atoms are trapped (two-dimensionally) in a line.

This 2D MOT is capable of trapping a stable line-shaped cold atomic cloud with a high optical depth. The zero magnetic field line along the symmetry axis leads to a long ground-state coherence time of the atoms without turning off the MOT magnetic field. Therefore, the 2D MOT is suitable for quantum optics research experiments at a high repetition rate, such as electromagnetically induced transparency, atomic memory and storage, single-photon and bi-photon generation.

The configuration differs from the conventional configuration in that two (of three) pairs of trapping laser beams in the disclosed 2D MOT setup do not follow the symmetry axis of the quadrupole magnetic field, but instead are aligned with a large non-zero degree angles. In one non-limiting example, an alignment of 45° is selected as an optimal alignment, with the optimal alignment used as a target alignment.

The six-beam alignment is considered to be an optimal configuration for a given total trapping laser power. With the six-beam configuration as a base, one can add more counter-propagating beam pairs to achieve similar trapping results. The selection of the six-beam configuration is made to obtain high optical depth and trap as many atoms as possible. It is possible to achieve a working MOT with more than 6 beams, but the non-six beam configurations are not optimal for a given total laser power.

In one disclosed configuration, a dark-line 2D MOT system is implemented. This configuration includes (a) an atom source, (b) a bakeable ultra-high vacuum cell, (c) a two-dimensional quadrupole magnetic field, (d) at least 6 trapping laser beams; and (e) two orthogonal repumping laser beams with a dark linecrossover at center along the longitudinal axis.

In this embodiment, two orthogonal repumping laser beams are used. In each repumping beam, an opaque line is imaged to the longitudinal axis of the 2D MOT. The overlap of these two line images creates a dark line volume in the longitudinal axis where there is no repumping light.

In one example of a dark-line 2D $^{85}$Rb MOT, with a trapping laser power of 40 mW and repumping laser power of 18 mW, we can obtain an atomic OD up to 160 in an electromagnetically induced transparency (EIT) scheme, which corresponds to an density-length product of $NL=2.05\times10^{15}\ m^{-2}$. In a closed two-state system, the OD can get as large as 600 or greater. The example 2D MOT configuration allows for full optical access of the atoms in its longitudinal direction without interfering with the trapping laser beams spatially. Moreover, the zero magnetic field along the longitudinal axis allows the cold atoms to maintain a long ground-state coherence time without switching off the MOT magnetic field, which makes it possible to operate the MOT at a high repetition rate and a high duty cycle. The 2D MOT is ideal for atomic ensemble based quantum optics applications, such as EIT, entangled photon pair generation, optical quantum memory, and quantum information processing.

An example configuration uses two orthogonal repumping laser beams. In each repumping beam, an opaque line is imaged to the longitudinal axis of the 2D MOT. An opaque line is placed outside the glass cell and in the path of the repumping beams to block some part of light. A lens is used to create an image of the wire to the middle of the atoms in the 2D MOT, resulting in two images of the opaque line. Overlap of the two wire images from both repumping beams creates a dark-line volume where the repumping light is absent. In one non-limiting example, the opaque line is established by a copper wire with a diameter of 0.6 mm, and the two images are images of the wire.

The six trapping laser beams still cover the entire MOT. Compared to the previous version without the repumping dark line, this dark-line 2D MOT is capable of producing a line-shaped cold atom trap with a much higher optical depth but with lower laser powers.

Configuration

The 2D MOT device allows production of laser cooled atomic ensemble with a high optical depth and a low ground-state dephasing rate (or a long coherence time). The apparatus comprises a bakeable ultra-high vacuum cell, a single hollow-core wire magnetic coil, and an optical alignment with six trapping laser beams. The features of the apparatus include the 2D quadrupole magnetic field generated from the magnetic coil and the laser beam alignment that allows maximum optical access to the cold atoms along the symmetry axis. The system can be run at a high repetition rate because the long atomic ground state coherence time can be achieved without the need of turning off the magnetic field.

FIG. 1 is a schematic illustration of a 2D MOT apparatus with an octagonal cell and magnetic coil, showing laser beam alignment. FIG. 1 shows an overview of the 2D MOT apparatus, which comprises a compact bakeable ultra-high vacuum chamber 111, a single hollow-core wire magnetic coil 120, and an optical alignment with six trapping laser beams, represented at 131, 132, 133, 134, 135, 136. Ultra-high vacuum chamber 111 comprises octagonal glass cell 140, six-way cross-chamber 143, feedthrough 145 with atomic dispensers, bakeable valve 151, connection link or nipple 153, a turbo molecular pump 161, and an ion pump 163. Glass cell 140, feedthrough 145, valve 151, and connection link 153 are connected to the six ports of six-way cross 143, as illustrated in FIG. 1. The Turbo molecular pump 161 is connected to a second port of valve 151. Ion pump 163 is connected to a second port of connection link 153. Turbo pump 161 runs only during the baking period for vacuum preparation. After baking is completed and the vacuum is prepared, ion pump 163 is started, valve 151 is closed, and then turbo pump 161 is switched off. Because turbo pump 161 does not run afterwards, it can be removed from the vacuum system after the ion pump 163 takes over. Therefore, turbo pump 161 can also be replaced by a standard turbo pump station. Surrounding the glass cell 140 is the magnetic coil 120. Six laser beams are aligned in the following way as illustrated in FIG. 1: one pair of counter-propagating beams 131 and 132 are centered and perpendicular to the big windows along the y axis, other two pairs of counter-propagating beams 133 and 134, 135 and 136 are aligned with 45 degree respected to the longitudinal symmetry x axis.

Figure 2A:
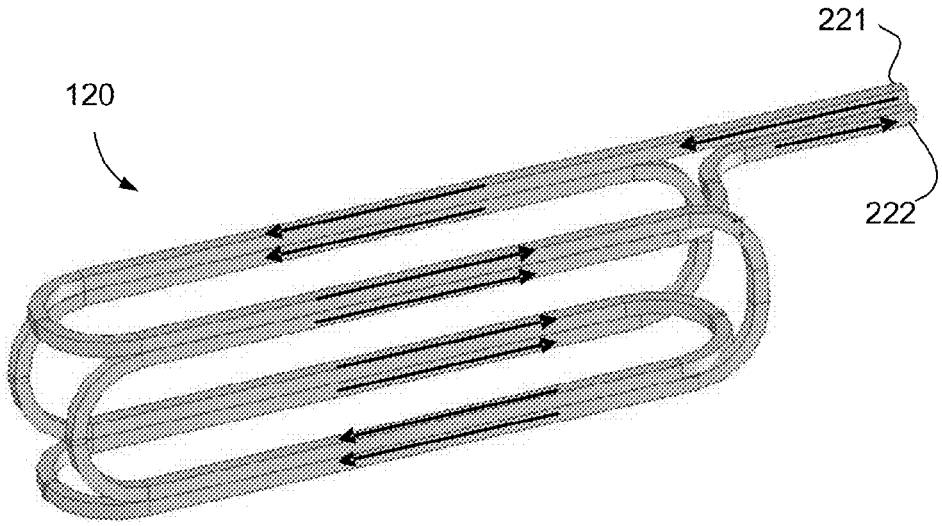
FIGS. 2A and 2B are schematic drawings of the single-wire magnetic coil and its wiring structure taken in two views.
Figure 2B:
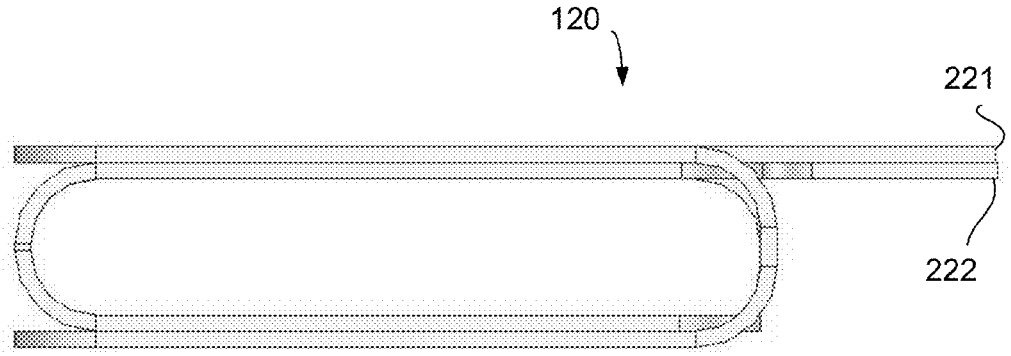

FIGS. 2A and 2B are schematic drawings of the single-wire magnetic coil and its wiring structure taken in two views, which shows details of magnetic coil structure 120. Magnetic coil 120 is made of a single hollow core wire or conductor with two connection ports 221, 222 that can be connected to an electric current supply. Assuming the current flows into connection port 221 and output from connection port 222, the arrows in FIGS. 2A and 2B show the current flow and wiring direction in this 3D coil structures. The current directions can be reversed. Use of a single wire eliminates the fluctuation of zero magnetic field points. The single wire design also minimizes the contact resistance of the coil for decreasing power consumption.

Figure 3A:
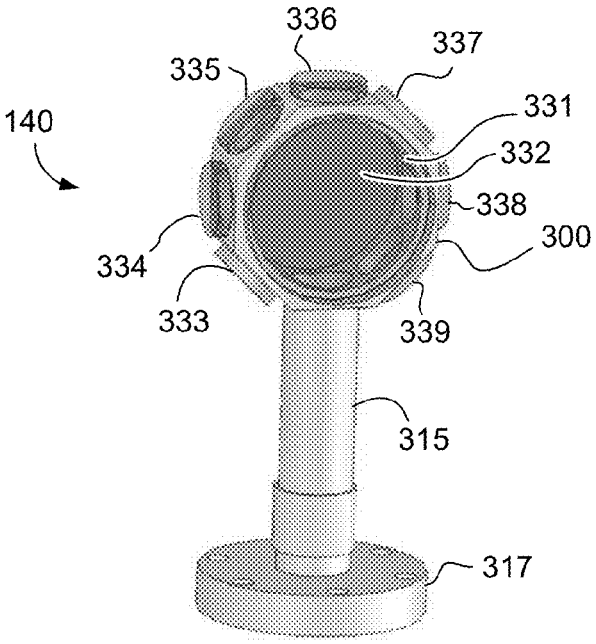
FIGS. 3A and 3B are schematic drawings of the octagonal glass cell.
Figure 3B:
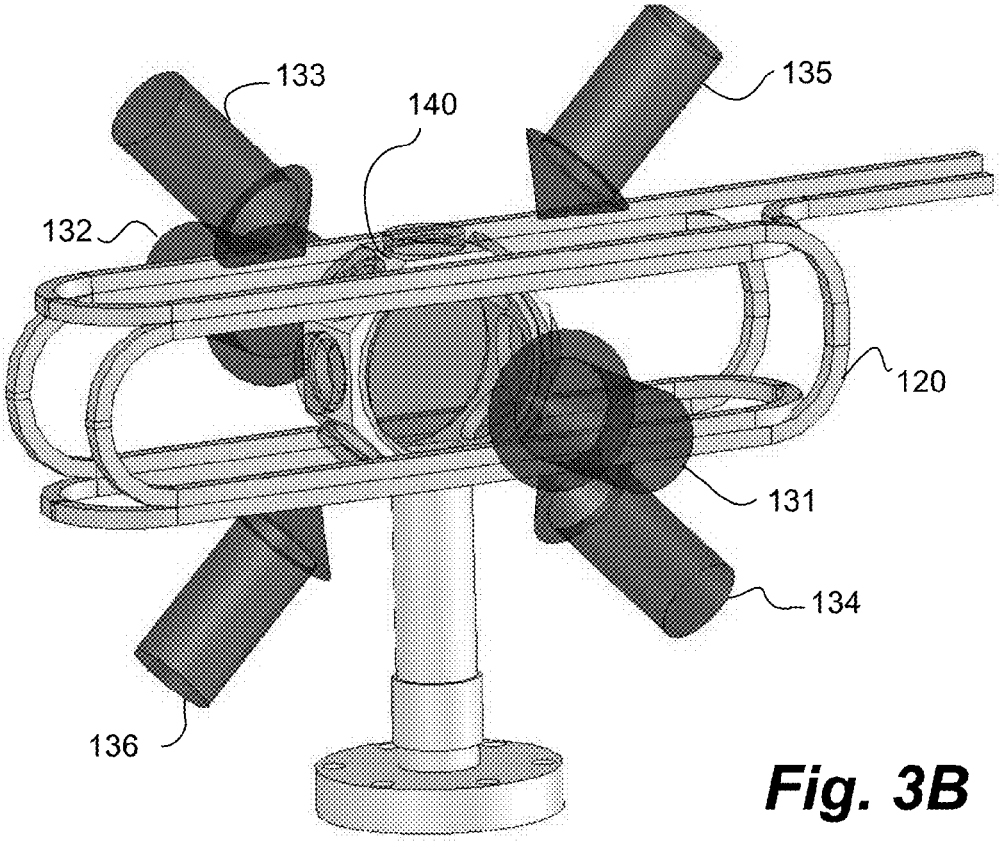

FIGS. 3A and 3B are schematic drawings of the octagonal glass cell. The detailed drawing of the octagonal glass cell 140 and its mounting fixture are depicted in FIG. 3A. Shown are octagonal glass chamber 300, glass-to-metal transition tube 315, and metal flange 317. Glass chamber 300 further comprises a pair of big windows 331, 332 on the front and back sides, and seven smaller windows 333-339 (the location for an eighth smaller window being occupied by transition tube 315).

FIG. 3B depicts octagonal glass cell 140 and its arrangement with magnetic coil 120 and six trapping laser beams 131-136. The six laser beams 131-136 are aligned in the following way: laser beams 131 and 132 are incident perpendicular to the two big windows 331, 332; beams 133 and 134 are incident perpendicular to the two small windows 335 and 339; beams 135 and 136 are incident perpendicular to the two small windows 337 and 333, respectively. Windows 334, 336 and 338 are left open and provide access for further experiments.

Figure 4A:
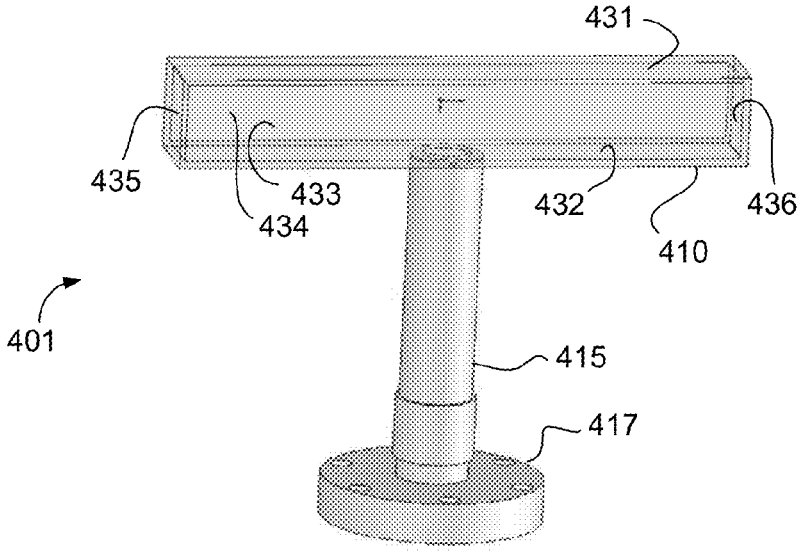
FIGS. 4A and 4B are schematic drawings of the rectangle glass cell.
Figure 4B:
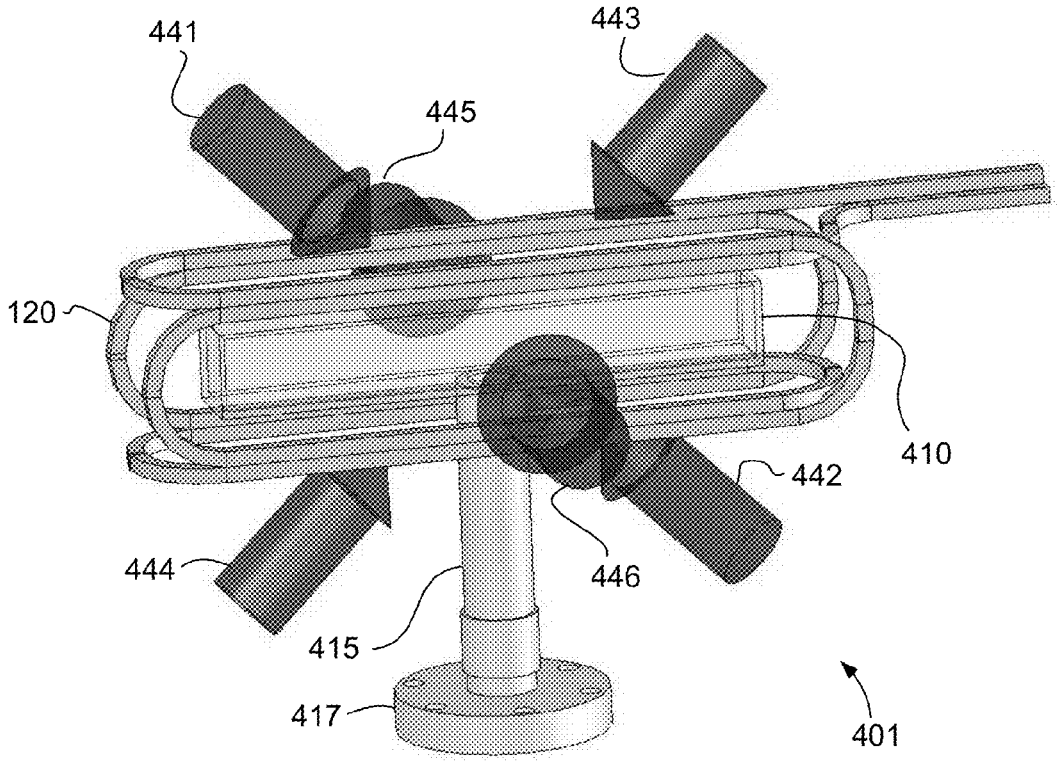

An alternative choice of the glass cell can be a rectangle shape. FIGS. 4A and 4B are schematic drawings of the rectangle glass cell. FIG. 4A shows the schematic drawing of a second embodiment of the glass vacuum cell 401 with a rectangle shape and its magnetic and optical alignments. The detailed drawing of the glass cell 401 is displayed in FIG. 4A, comprising a rectangle-shaped glass chamber 410, a glass-to-metal transition tube 415, and a metal flange 417. Glass chamber 410 further includes four rectangle-shaped windows 431-434 and a pair of square side windows 435 and 436.

FIG. 4B depicts the glass cell 410 and its arrangement with magnetic coil 120 and the six trapping laser beams 441-446. The six laser beams are aligned towards the four rectangular windows. Square side windows 435, 436 are left open to provide access for further experiments.

Figure 5:
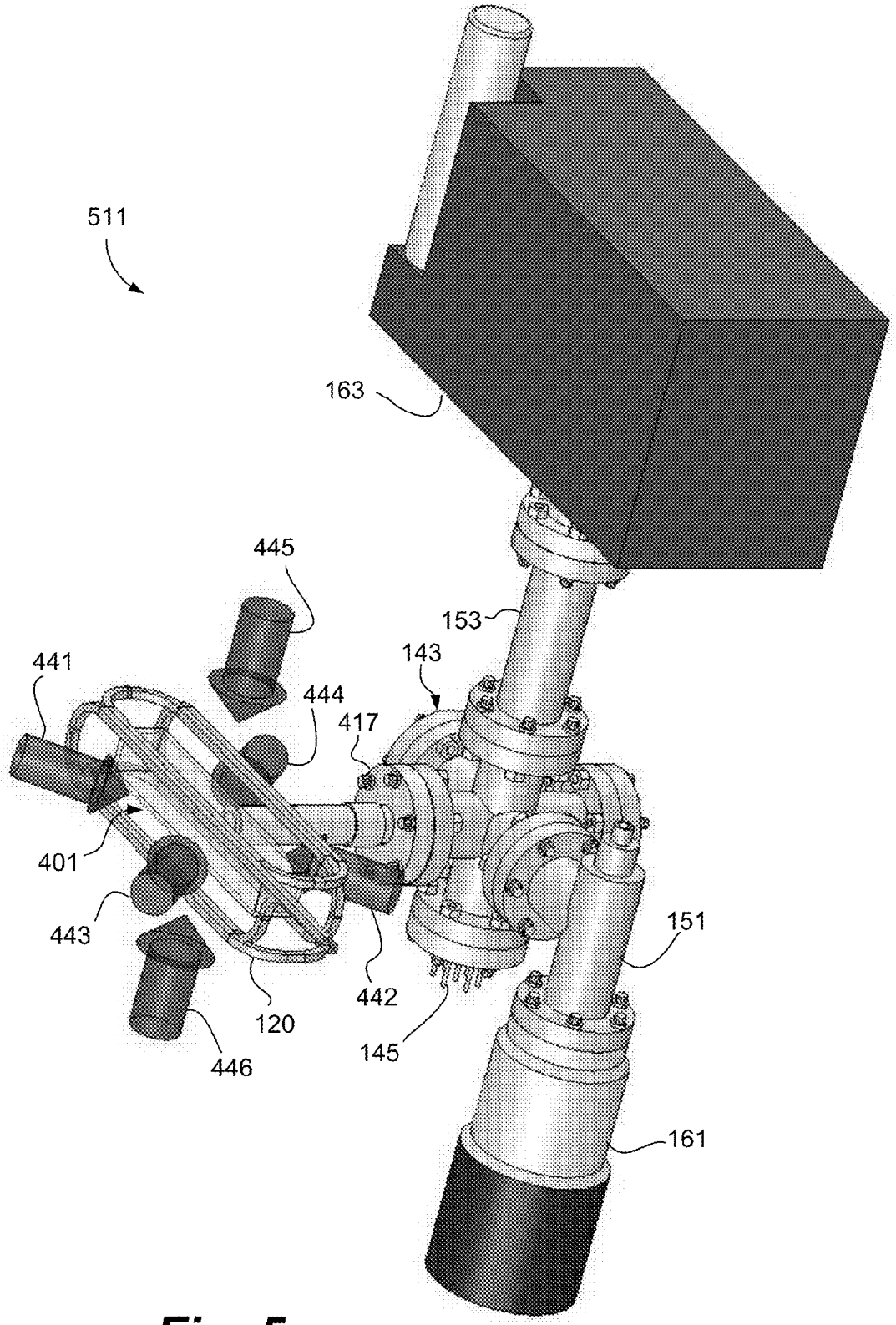
FIG. 5 is a schematic illustration of the 2D MOT apparatus structure with the rectangle vacuum cell, the magnetic coil and the laser beam alignment.

FIG. 5 is a schematic illustration of the 2D MOT apparatus structure 511 with the rectangular glass vacuum cell 401, the magnetic coil and the laser beam alignment. The overall configuration is the same as that of FIG. 1.

Figure 6:
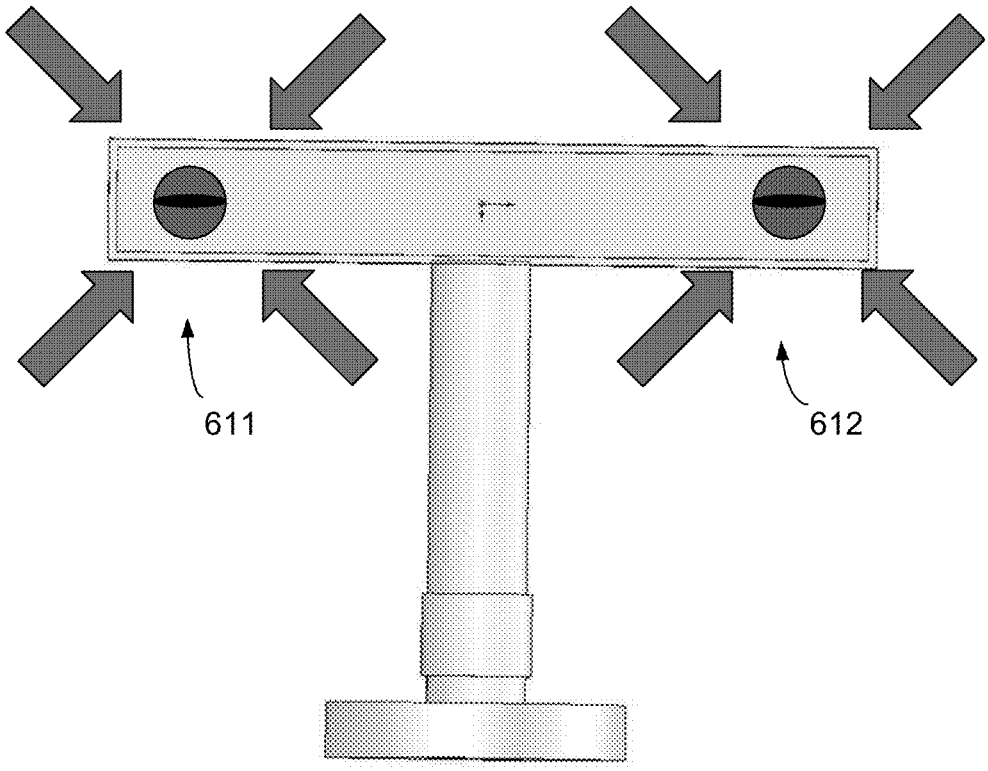
FIG. 6 is a schematic drawing showing two MOTs are created in a single rectangle cell.

The apparatus with the rectangle-shape cell 401 can also be used to create multiple MOTs along the longitudinal axis. As an example, FIG. 6 is a schematicdrawing showing two MOTs are created in a single rectangle cell showing a two-MOTconfiguration with the rectangle-shape cell. With the same 2D quadrupole magnetic field and two sets of trapping lasers, two separated MOTs 611 and 612 are formed as shown in the figure. The principle can be extended to more than two MOTs.

Figure 7A:
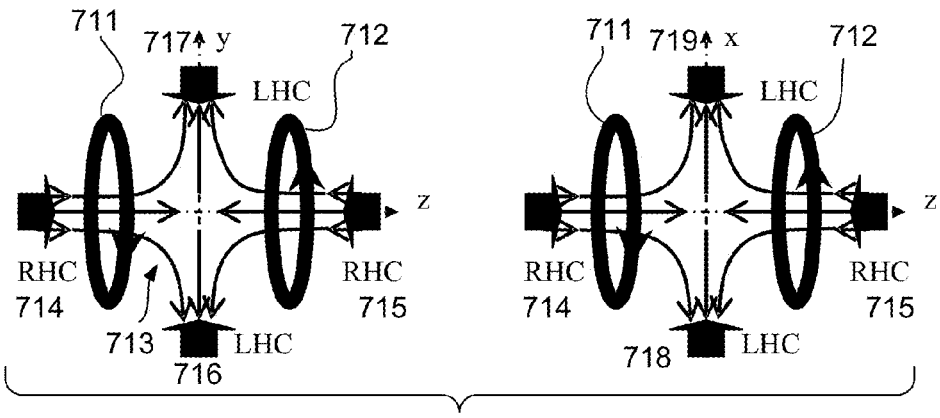
FIGS. 7A-C are schematic diagrams showing comparisons of the laser beam configurations with respect to the magnetic field pattern in a conventional 3D MOT (FIG. 7A), a conventional 2D MOT (FIG. 7B) and a 2D MOT having a 45-degree beam alignment (FIG. 7C).
Figure 7B:
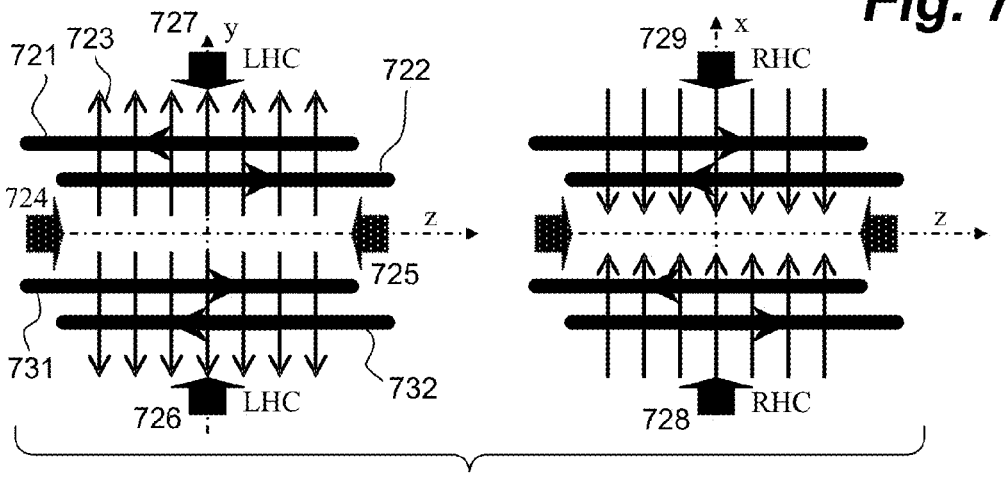
Figure 7C:
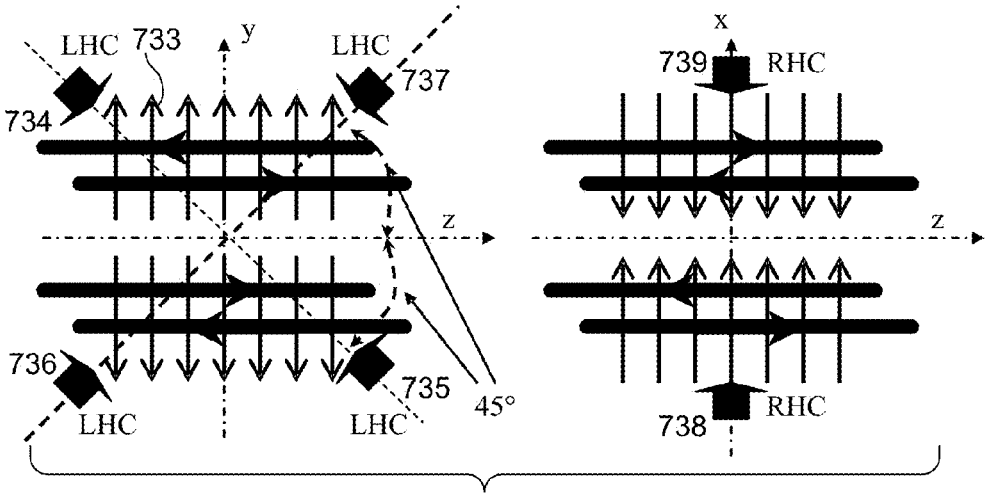

FIGS. 7A-C are schematic comparisons of the laser beam configurations in the conventional 3D MOT (FIG. 7A), a conventional 2D MOT (FIG. 7B) and the described 2D MOT (FIG. 7C).

The physics mechanism of 45-degree beam alignment is shown in FIG. 7C, as a comparison with the conventional 3D MOT alignment in FIG. 7A and the conventional 2D MOT alignment in FIG. 7B. As shown in FIG. 7A, in the conventional 3D MOT, the magnetic field 713 is produced from a pair of anti-Helmholtz coils 711 and 712, with opposite electric currents. The arrows along the magnetic lines 713 indicate the directions of the magnetic field. To illustrate clearly how the laser beams are aligned, the 3D plots are separated onto y-z and x-z planes, where z is the longitudinal symmetry axis. Using the configuration as shown in FIG. 7A, the magnetic field on the −z axis points toward +z direction, while on the +z axis toward −z direction. The magnetic field on the −x (or −y) axis points toward −x (−y) direction, while on the +x (or +y) axis points toward +x (+y) direction. Six laser beams 714, 715, 716, 717, 718, and 719 and their circular polarizations are aligned related to the magnetic field directions. Here the circular polarizations of right-handedness (RHC) and left-handedness (LHC) are taken as defined from the point of view of the receiver.

In the 3D MOT configuration, the circular polarizations of the six beams are show in FIG. 7A: in the z axis, the two laser beams 714 and 715 are both in RHC, while all other four beams are in LHC. The system has a rotational symmetry along z axis and there is no preference in choosing x and y axes in the x-y plane. In the conventional 2D MOT configuration as shown in FIG. 7B, the magnetic field 723 can be molded as that produced from four straight wires 721, 722, 731, and 732 which result in a zero magnetic field along z axis. In the four-beam 2D MOT configuration, there is no laser beam along z axis. The laser beams 726, 727, 728, and 729 polarizations along y and x directions are illustrated in FIG. 7B and they are all perpendicular to the z axis. This configuration has no cooling along z axis and it is commonly used to generate moving atomic beams. To add additional cooling along z direction, people add a pair of counter-propagating beams 724 and 725 to the z axis. There is no polarization preference for these two beams because the magnetic field along z axis is zero.

The 2D MOT six laser beam alignment configured according to the present disclosure is shown in FIG. 7C. The disclosed 2D MOT is different from the conventional alignments in that the four laser beams in the y-z plane are not aligned along the magnetic field directions; that is, y and z axes. The four laser beams 734, 735, 736, and 737 are aligned with 45 degree angles with respect to the z axis. In other words, they are also aligned with 45 degree angles to the magnetic field lines 733. The polarizations of these four beams are all LHC. Along the x axis, the two laser beams take the same configuration as the conventional design with RHC polarizations. This unique beam configuration not only allows a stable MOT with high optical depth, but also opens full optical access along z axis for experiment. The above description is presented for purpose of illustration. As mentioned, the laser beam polarizations are closely related to the magnetic field directions. In the above configurations in FIGS. 7A, B and C, if all the magnetic field directions change to their opposite (which could be done by switching the directions of the electric current), one should change the polarizations from RHC to LHC, and from LHC to RHC.

Figure 8:
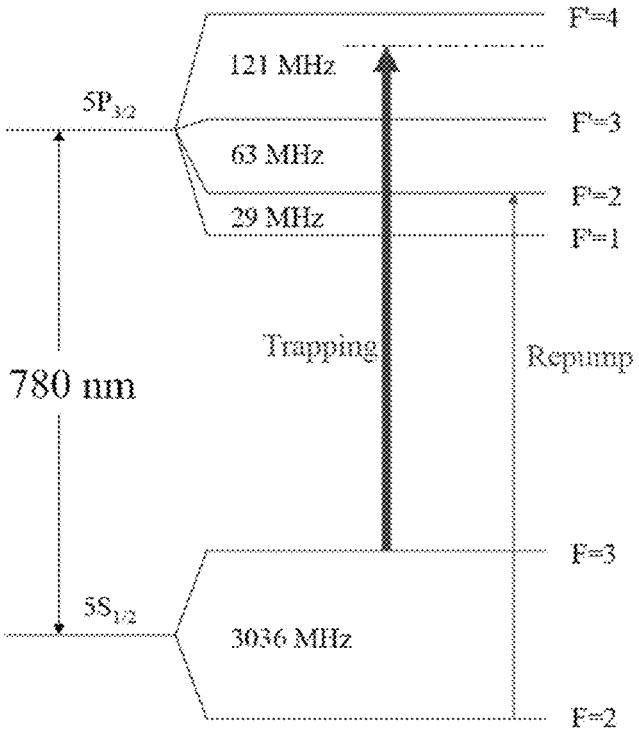
FIG. 8 is a diagram depicting involved Rb85 atomic energy levels and laser transitions.

FIG. 8 is the $^{85}$Rb atomic energy level diagram laser frequency configuration for the disclosed 2D MOT. The six trapping laser beams, red detuned by 20 MHz from the transition $|5S_{1/2}, F=3\rangle \rightarrow |5P_{3/2}, F=4\rangle$, have a total power of about 100 mW. The repump laser, on resonance with the transition $|5S_{1/2}, F=2\rangle \rightarrow |5P_{3/2}, F=2\rangle$, overlaps with one of the six trapping laser beams and has a power of 10 mW.

Figure 9A:
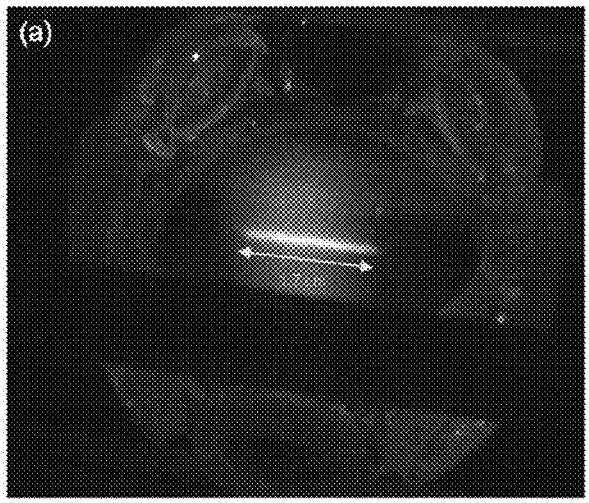
FIGS. 9A and 9B are fluorescence images of cold $^{85}$Rb atoms in the MOT viewed from the x direction (FIG. 9A) and y direction (FIG. 9B).
Figure 9B:
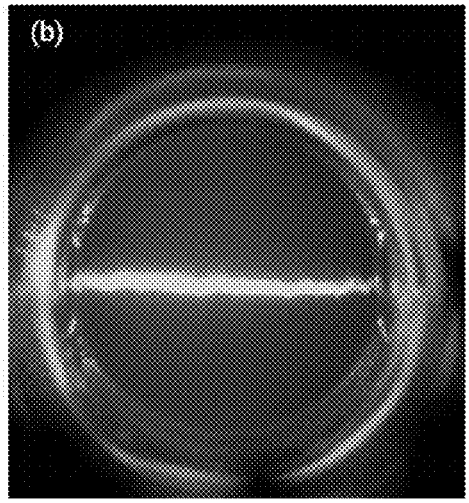

FIGS. 9A and 9B are fluorescence images of cold $^{85}$Rb atoms in the MOT viewed from the x direction (FIG. 9A) and viewed from the y direction (FIG. 9B). The fluorescence image of the trapped atoms shown in FIG. 9, depict atoms having an atom number of about $10^8$~$10^9$ and a temperature of 100 μK. Referring back to FIG. 3, the image in FIG. 9A is taken through window 331 or 332 and the image in FIG. 9B is taken through the transition tube 315.

Dark-Line 2D MOT Apparatus

The dark-line 2D MOT device produces a laser cooled atomic ensemble with a high optical depth and a low ground-state dephasing rate (or a long coherence time). The apparatus comprises a bakeable ultra-high vacuum cell, a 2D quadrupole magnetic field, at least six trapping laser beams, and two orthogonal repumping beams with a dark line crossover. In the following description, for the purpose of illustration, $^{85}$Rb atoms are taken as a demonstrated example. The principles described here can be applied to other neutral atoms.

Figure 10A:
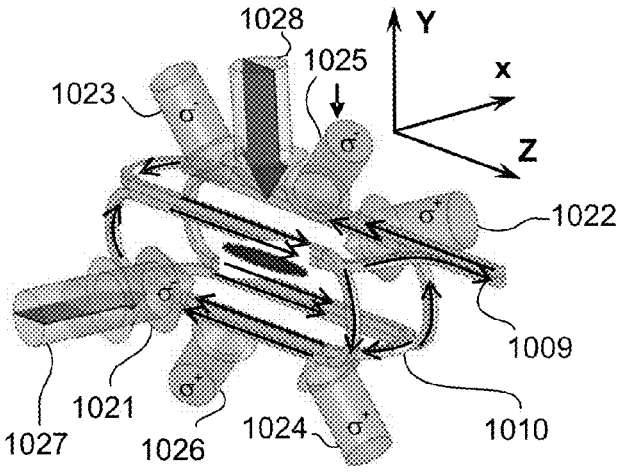
FIGS. 10A-10C are schematic illustrations of a dark-line 2D MOT magneto-optical configuration.
Figure 10B:
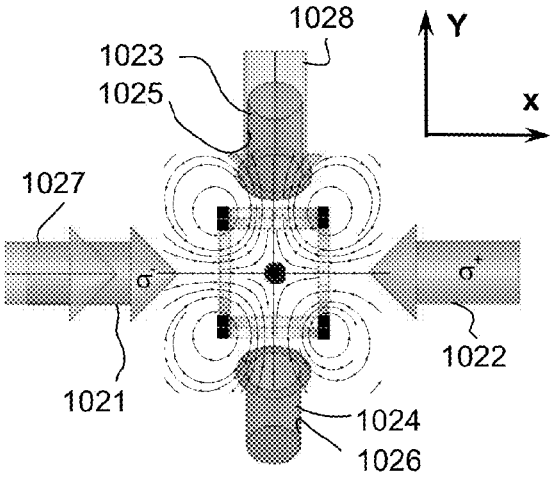
Figure 10C:
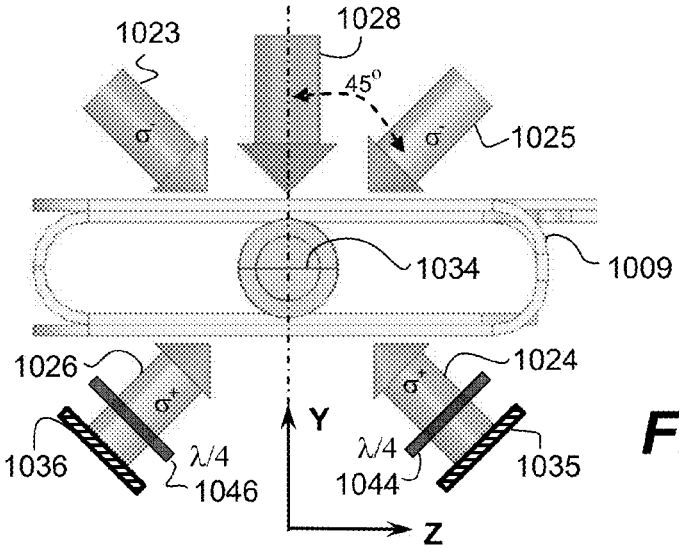

FIGS. 10A-10C are schematic illustrations of a dark-line 2D MOT setup. FIG. 10A is a 3D view. FIGS. 10B and 10C are cross section views in x-y and y-z planes, respectively. The $^{85}$Rb $D_2$ line energy levels and MOT laser transitions would be similar to those illustrated in FIG. 8, which provides an example of application.

The magneto-optical configuration comprises a 2D quadrupole magnetic field produced from a magnetic coil 1009 with a current represented by arrows 1010. Also shown are six trapping beams 1021, 1022, 1023, 1024, 1025, and 1026, and two repumping beams 1027 and 1028 with an overlapping dark line 1034, depicted in FIG. 10C. One pair of counter-propagating trapping laser beams 1021 and 1022 are aligned along the x axis. Different form the conventional 2D and 3D MOT optical alignments, the other four trapping beams are not aligned along the symmetry axes of the magnetic field. For example, in the conventional 2D MOT configuration, these four trapping beams are aligned along y and z axes. In contrast, in the present 2D MOT setup, these four trapping beams 1023, 1024, 1025, and 1026 are aligned at non-zero degree (the optimal value is 45°) angles to the y and z axes, as shown in FIG. 10C. Because the atoms are trapped along the longitudinal x axis, this configuration opens full optical access along the atom line which is the direction for high optical depth. With the illustrated magnetic coil current direction and magnetic field, the polarizations $\sigma^+$ and $\sigma^-$ of the six trapping beams are also shown in FIGS. 10A, 10B and 10C. To efficiently making use of the trapping laser power, the two 45° beams are retro reflected by the mirrors 1035 and 1036 through quarter wave plates 1044 and 1046 as shown in FIG. 10C. Two repumping laser beams are used. The repumping beam 1027 overlaps with the trapping beam 1021 along the x axis. The repumping beam 1028 is aligned along the y axis. In each repumping beam, there is an opaque wire line. The images of these opaque wires, through a lens imaging system in each beam, overlaps at the center of the 2D MOT and creates a dark line 1034 of the repumping beams along the z axis. In the dark line regime, the atoms are pumped into the dark state without interacting with the trapping laser and thus avoid the radiation trapping loss and heating. In the demonstrated $^{85}$Rb 2D MOT example, the trapping laser is red detuned by 20 MHz from the transition $|5S_{1/2}, F=3\rangle \rightarrow |5P_{3/2}, F=4\rangle$, and the repumping laser is on resonance with the transition $|5S_{1/2}, F=2\rangle \rightarrow |5P_{3/2}, F=2\rangle$. Both trapping and repumping beams have the same beam diameter of 2 cm. The total laser powers are 40 mW and 18 mW, for the trapping laser and repumping laser, respectively.

Figure 11A:
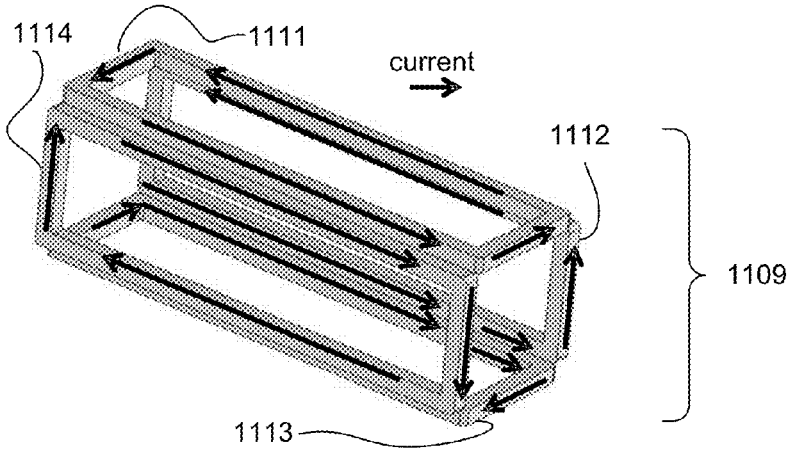
FIGS. 11A and 11B are schematic drawings of two other configurations for producing the 2D MOT quadrupole magnetic field.
Figure 11B:
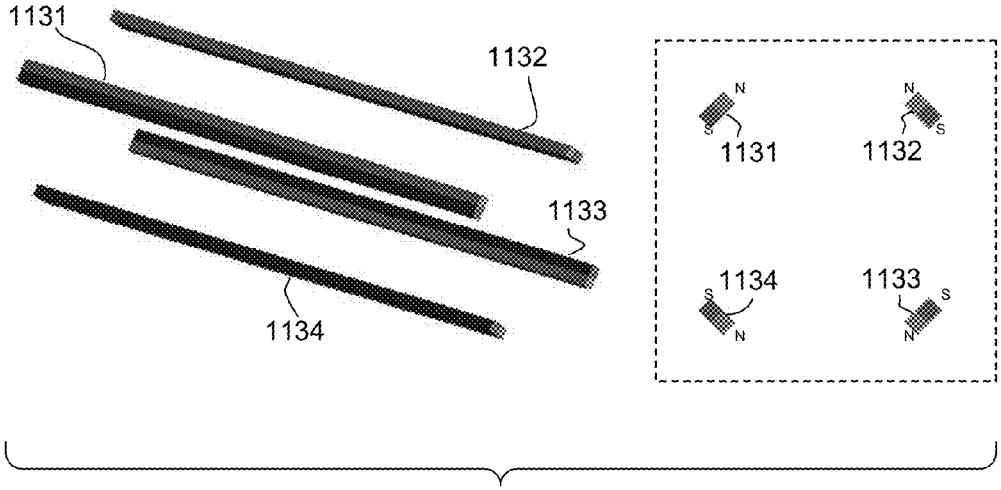

Water-cooled magnetic coil shown in FIGS. 10A-10C is made of a single hollow-core copper wire with a square cross section, which is similar to that shown in FIGS. 2A and 2B. FIGS. 11A and 11B depict the magnetic fields established by magnetic coil 1009. The small inductance (~100 μH) of this coil also allows us to switch on and off the magnetic field in a short time. Controlling the magnetic field is necessary for obtaining the atomic ground state coherence time of more than 10 μs. A dephasing rate of $\gamma_{12}=2\pi\times0.03$ MHz between the two ground levels is obtained, which corresponds to a coherence time of $\tau_{12}=5.3$ μs, without switching off the 2D MOT quadrupole magnetic field during the measurement. If such several-μs coherence time is long enough for applications, the quadrupole magnetic field can be caused to remain on continuously and the magnetic coil can be simplified. In this case, the magnetic coil 1009 set can be assembled from four independent coils (1111, 1112, 1113, and 1114), as shown in FIG. 11A. There are multiple turns in each coil so that they can be driven by a low current power supply without additional water cooling. Such a steady MOT magnetic field can also be generated by 4 permanent magnet bars (1131, 1132, 1133, and 1134) aligned in the configuration shown in FIG. 11B. Using permanent magnet bars dramatically simplify the system and reduce the power consumption because it can be self-standing without using any electrical power supply. While water cooling is described, it is anticipated that alternate liquid coolants may be used.

Therefore, the magnetic field can remain on continuously during an experiment while maintaining a ground state coherence time of up to 5 μs. The magnetic field can be turned off for obtaining a ground state coherence time of more than 5 μs.

The dark-line 2D MOT can perform the functions of 2D MOT apparatus of FIG. 1. The fluoroscopic images obtained from cold atoms of $^{85}$Rb depicted in FIGS. 9A and 9B are also representative of the output of the dark-line 2D MOT apparatus. EIT measurements are taken to characterize the 2D MOT properties. EIT, as quantum interference between atomic transitions, has been widely used to manipulate optical response of an atomic medium, and found its wide applications in slow light, nonlinear wave mixing, optical switching, entangled photon pair generation, optical quantum memory, and quantum information processing. For illustration purpose, the following measurements are performed with a $^{85}$Rb 2D MOT.

Figure 12A:
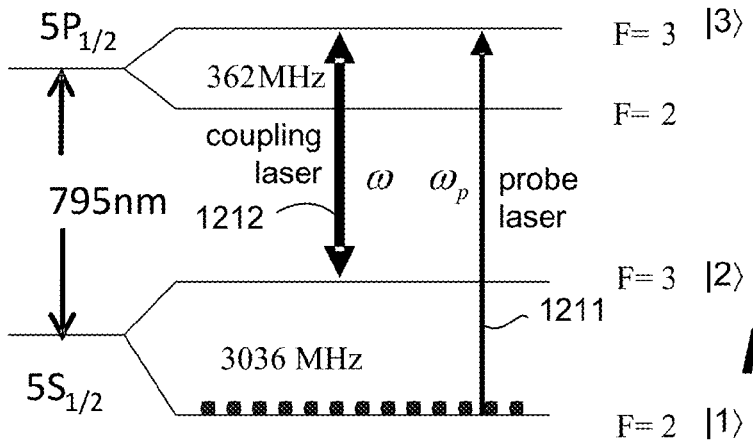
FIGS. 12A-12C are diagrams showing an EIT measurement scheme.
Figure 12B:
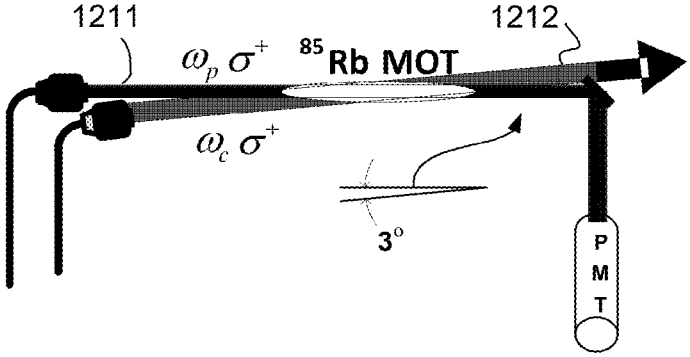
Figure 12C:
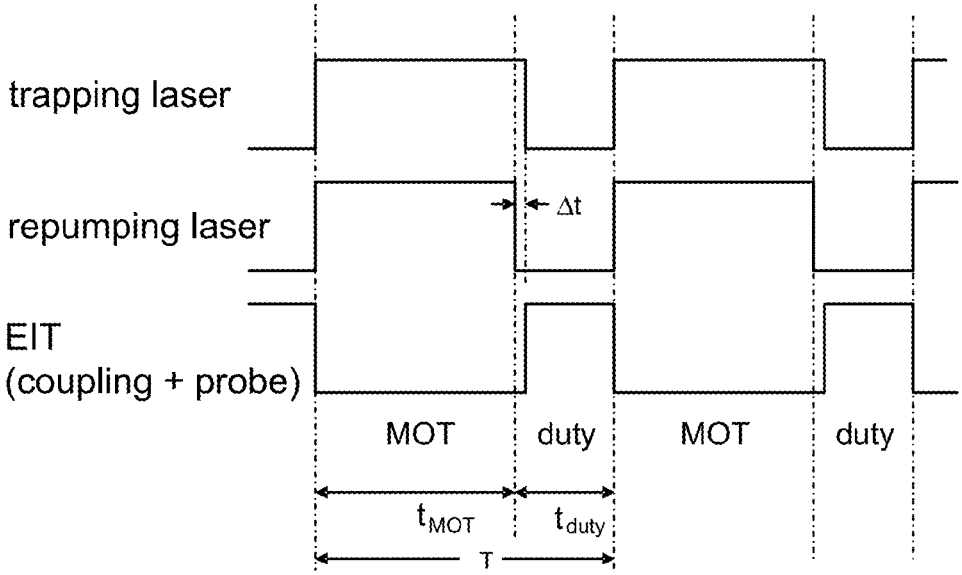

FIGS. 12A-12C are diagrams showing an EIT measurement scheme showing primary results of electromagnetically induced transparency. FIGS. 12A and 12B show a weak probe laser beam 1211 and a coupling laser beam 1212. Coupling laser beam 1212 has an angle with respect to the probe beam 1211. As a non-limiting example, the angle between laser beams 1211 and 1212 is set at 3°. FIG. 12A depicts the involved EIT atomic energy level diagram in $^{85}$Rb D1 lines (795 nm), FIG. 12B depicts the EIT optical setup, and FIG. 12C depicts the MOT and EIT measurement timing. An EIT Λ system is considered in the following three levels:

$$|1\rangle=|5S_{1/2},F=2\rangle,\ |2\rangle=|5S_{1/2},F=3\rangle,\text{ and }|3\rangle=|5P_{1/2},F=3\rangle.$$

As depicted in FIG. 12B weak probe laser ($\omega_p$) beam 1211 propagates along the 2D MOT longitudinal z axis and is focused to the center of the MOT with a $1/e^2$ beam diameter of 245 μm at the waist. The probe absorption spectrum is measured with a photomultiplier tube by scanning its frequency across the transition $|1\rangle\rightarrow|3\rangle$. To ensure that linear propagation effect is studied, the intensity of the probe laser is kept sufficiently low that the atomic population remains primarily in the state $|1\rangle$. A collimated coupling laser beam 1212 ($\omega_c$) on resonance at the transition $|2\rangle\rightarrow|3\rangle$ and with a $1/e^2$ beam diameter of 1.6 mm, passes through the cold atoms with an angle of 3° respect to the probe laser beam. Both the probe and coupling laser beams have the same circular polarizations $\sigma^+$ to optimize the EIT effect. The measurement is taken periodically. At each period of T=5 ms, the MOT trapping time is set at $t_{MOT}$=4.2 ms and the measurement duty (including state preparation and EIT measurement) time is set at $t_{duty}$=0.8 ms. At the end of each MOT trapping time after the repumping laser is switched off, the trapping laser remains on for additional Δt=0.3 ms to optically pump all the atoms into the ground state $|1\rangle$, which is preferable for the EIT scheme. To reduce this time of 0.3 ms in the duty window, one can also use an additional on-resonance laser to pump the atoms more efficiently in a much shorter time (<50 μs). After the atoms are prepared in the ground state $|1\rangle$, the probe and/or coupling lasers are switched on for absorption measurement inside the duty window. The disclosed device can also be used to trap $^{87}$Rb and other alkali atoms.

Figure 13A:
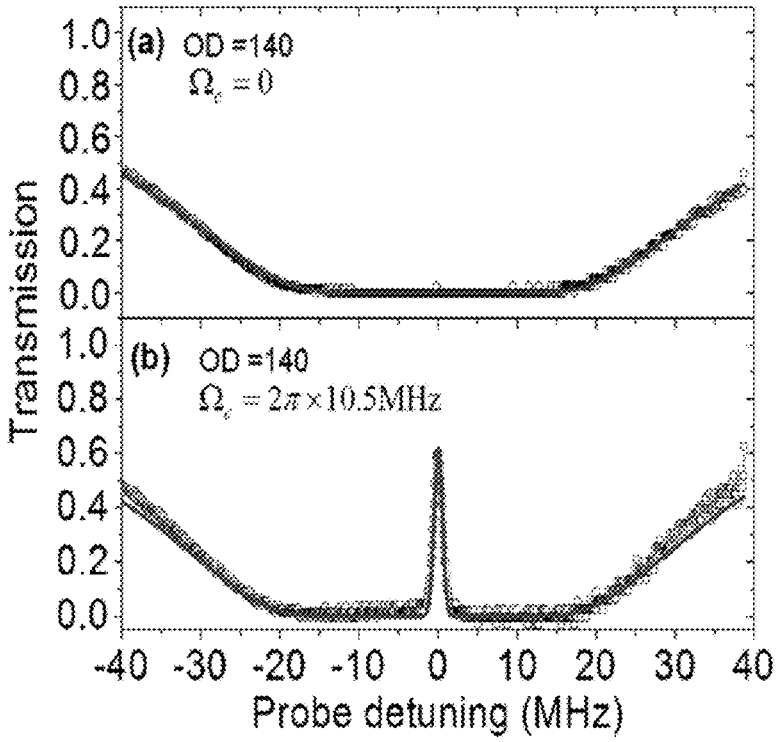
FIGS. 13A and 13B are diagrams showing a primary absorption measurement result of the dark-line 2D MOT.
Figure 13B:
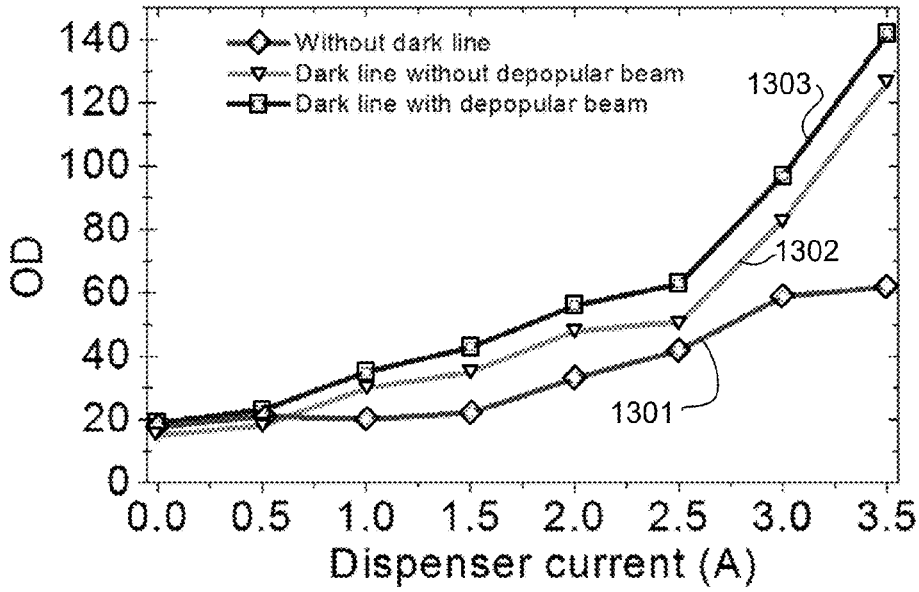

FIGS. 13A and 13B are diagrams showing a primary absorption measurement result of the dark-line 2D MOT. The probe absorption spectrum profile at OD=140 is depicted in FIG. 13A in a two-level system and an EIT system. When the coupling laser is not present ($\Omega_c$=0), the EIT reduces to a two-level system and the probe laser gets maximally absorbed on resonance, shown in FIG. 13A.

FIG. 13B is a graphic depiction showing the measured OD as a function of the current of two dispensers. When the coupling laser is switched on with $\Omega_c=2\pi\times10.5$ MHz, it renders the medium a narrow transparent window around the resonance, as shown in FIG. 13A. When the 2D MOT is operated without the dark line, it is found that the OD reaches a saturation value of 60 as the current approaches 3.5 A, as shown in plot 1301. In the dark-line 2D MOT configuration, a significant increase of OD to 130 at a high dispenser current is observed, as indicated at plot 1302. During the measurement, it was found that the repumping beam is not completely dark at the dark line due to scattering, diffraction, and the imperfectness of the imaging system. To solve this problem, the coupling laser is turned on during the MOT time at a very weak power of 10 μW to act as a depopular beam. The measured OD with the depopular beam is shown in plot 1303, and slight increase of OD from 130 to 140 at the dispenser current of 3.5 A is observed. A higher OD is achievable at a larger dispenser current.

Another important number for characterizing the system performance is the duty cycle, defined as the ratio of duty window time length to the period $$\eta=\frac{t_{duty}}{T} \tag{1}$$

Because the MOT time and EIT application duty window must be separated at different time slots, the duty cycle reflects the use efficiency of the cold atoms. During the duty window, some atoms are lost from the trap because of the background collision, free expansion, and falling under the gravity. As a result, the optical depth drops the duty cycle is increased. The above measurements at OD=140 are taken with a duty cycle η=16%. The duty cycle can be varied by changing either the MOT trapping time $t_{MOT}$ or the duty time $t_{duty}$.

Figure 14:
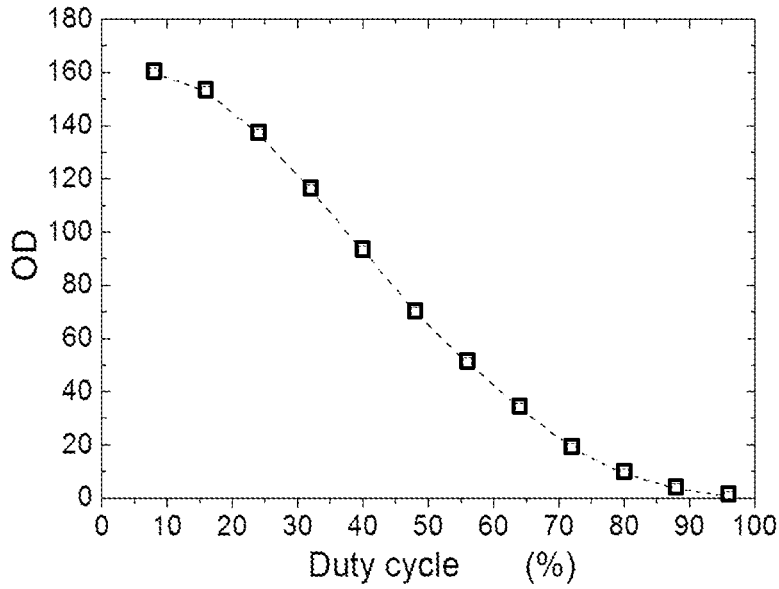
FIG. 14 is a graphic depiction of the measured OD in the dark-line 2D MOT as a function of the duty cycle.

FIG. 14 is a graphic depiction showing the measured OD as a function of duty cycle at the dispenser current of 3.5 A. At a reduced duty cycle of 8%, higher OD up to 160 is obtained. As the duty cycle is increased to 35%, an OD more than 100 remains. For most applications where an OD of about 50 is enough, it is possible to run the 2D MOT with a duty cycle of 55%. If an OD of 10 is needed, it is possible to increase the duty cycle up to 80%.

The above-mentioned OD is in the EIT three-level scheme where $|1\rangle\rightarrow|3\rangle$ is an open transition with an absorption cross section $$\sigma_{13}=\frac{7}{27}\frac{3\lambda_p^2}{2\pi}.$$

Here $\lambda_p$ is the on-resonance probe laser wavelength. With the atomic density N, the optical depth can be expressed as $OD=\alpha_0L=N\sigma_{13}L$. Therefore, the product of atomic density N and length L is independent of the transition strength of the chosen states. At OD=160, $NL=2.05\times10^{15}$ m$^{-2}$ for the $^{85}$Rb dark-line 2D MOT is obtained. In a closed two-state system, such as $|5S_{1/2}, F=3, M_F=3\rangle \rightarrow |5P_{3/2}, F=4, M_F=4\rangle$, the absorption cross section becomes $$\sigma_0 = \frac{3\lambda_p^2}{2\pi}$$

and it is possible to get an OD of more than 600.

Number of Trapped Beams

The 6 trapping beam configuration (3 pairs of trapping beams) shown in FIG. 7C is an optimal configuration geometry given by way of non-limiting example. The minimum number of trapping beams for obtaining a stable MOT described is 6 trapping beams (or 3 pairs). In general, there can be more than 3 pairs of trapping laser beams.

Figure 15:
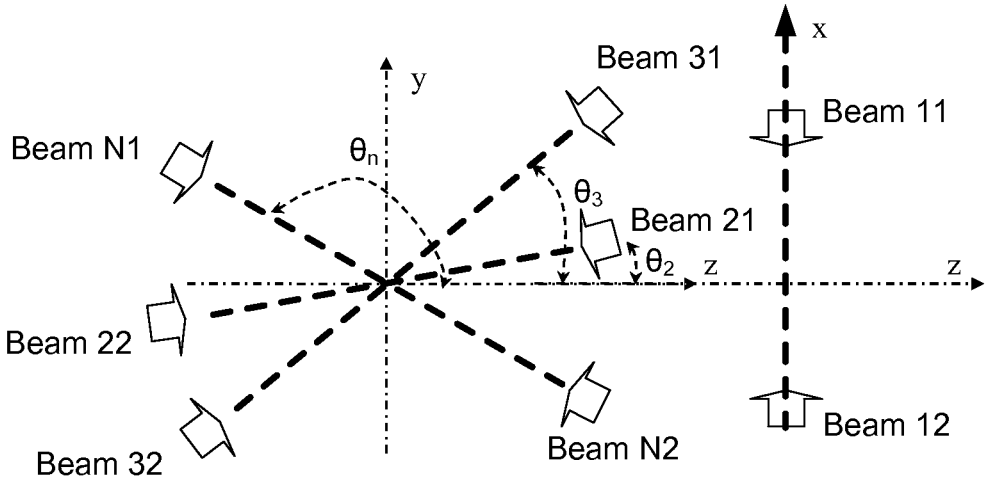
FIG.15 is a schematic diagram showing the general laser beam configuration for n pair of trapping beams, where n≥3.

FIG.15 is a schematic diagram showing the general laser beam configuration for n pair of trapping beams, where n≥3. The coordinate system x-y-z is the same as that shown in FIG. 7C. A pair of trapping beams comprises two counter-propagating trapping beams, so that for the nth pair of beams (labeled as Pair n), their two counter-propagating beams are denoted as Beams n1 and n2. The first pair of beams (Beam 11 and Beam 12) are aligned along the x axis, and all other n−1 pairs of beams are aligned in the y-z plane and overlap in the volume around the original point (x=0, y=0, z=0). These n−1 pairs (n≥3) of beams in the y-z plane have non-zero angles to the z axis in order not to block the path along the z axis. As shown in FIG. 15, Beam Pair 2 (Beams 21 and 22) are aligned with an angle $\theta_2$ to the z axis, Beam pair 3 (Beams 31 and 32) are aligned with an angle $\theta_3$ to the z axis, . . . , and Beam pair n (Beams n1 and n2, with n≥3) are aligned with an angle $\theta_n$. The values of these angles can be chosen in the range of larger than zero and smaller than 180°.

Conclusion

It will be understood that many additional changes in the details, materials, steps and arrangement of parts, which have been herein described and illustrated to explain the nature of the subject matter, may be made by those skilled in the art within the principle and scope of the invention as expressed in the appended claims. The principles described here can be applied to cool and trap other neutral atoms which require trapping and repumping lasers at different wavelengths.

What is claimed is:

1. A two-dimensional magneto-optical trap (MOT) device, comprising:

an atom source;

a bakeable ultra-high vacuum cell;

a two dimensional quadrupole magnetic field;

3+n pairs of counter-propagating trapping laser beams, wherein n is an integer larger than or equal to zero, the trapping laser beams comprising one pair of counter-propagating beams perpendicular to a magnetic field longitudinal symmetry axis, and the remaining 2+n pairs of counter-propagating beams, with no trapping laser beams on the magnetic field longitudinal symmetry axis; and at least one repumping laser beam.

2. The two-dimensional magneto-optical trap device of claim 1, wherein n=0, with one pair of counter-propagating beams perpendicular to the magnetic field longitudinal symmetry axis, and the remaining 2 pairs of counter-propagating beams having a target alignment of a 45 degree angle to the magnetic field longitudinal symmetry axis and perpendicular to the first pair of counter-propagating beams.

3. The two-dimensional magneto-optical trap device of claim 1, wherein said bakeable ultra-high vacuum cell comprises a glass cell chamber, a glass-to-metal transition tube, and a metal flange.

4. The two-dimensional magneto-optical trap device of claim 3, wherein said glass cell chamber has one of an octagonal shape or a rectangular shape.

5. The two-dimensional magneto-optical trap device of claim 1, wherein said two-dimensional quadrupole magnetic field has a zero field line along the magnetic field longitudinal symmetry axis and the magnetic field remains on continuously during an experiment while maintaining a ground state coherence time of up to 5 μs

6. The two-dimensional magneto-optical trap device of claim 1, wherein said two-dimensional quadrupole magnetic field has a zero field line along the magnetic field longitudinal symmetry axis and turning off the magnetic field results in obtaining a ground state coherence time of more than 5 μs.

7. The two-dimensional magneto-optical trap device of claim 1, wherein the two-dimensional quadrupole magnetic field is established with a three-dimensional single-wire magnetic coil, the coil comprising a single hollow-core wire or conductor without any interconnection, provided with a liquid cooling passage, wherein the single hollow-core wire or conductor has no interconnection and provides a continuous and smooth path for electricity and provides a liquid cooling passage.

8. A dark-line two-dimensional magneto-optical trap (MOT) device, comprising:

an atom source;

a bakeable ultra-high vacuum cell;

a two dimensional quadrupole magnetic field;

3+n pairs of counter-propagating trapping laser beams, wherein n is an integer larger than or equal to zero, the trapping laser beams comprising one pair of counter-propagating beams perpendicular to the symmetry axis, and the remaining 2+n pairs of counter-propagating beams aligned in a plane perpendicular to the first pair of counter-propagating beams; and two orthogonal repumping laser beams with a dark line crossover at center along the longitudinal axis.

9. The dark-line two-dimensional magneto-optical trap device of claim 8, wherein for the optimal trapping beam has a configuration with n=0, one pair of counter-propagating beams are perpendicular to the symmetry axis, and the remaining 2 pairs of counter propagating beams have a target alignment of a 45 degree angle to the longitudinal symmetry axis and perpendicular to the first pair of counter-propagating beams.

10. The dark-line two-dimensional magneto-optical trap device of claim 8, wherein said bakeable ultra-high vacuum cell comprises a glass cell chamber, a glass-to-metal transition tube, and a metal flange.

11. The dark-line two-dimensional magneto-optical trap device of claim 10, wherein said glass cell chamber has one of an octagonal shape or a rectangular shape.

12. The dark-line two-dimensional magneto-optical trap device of claim 8, wherein said two-dimensional quadrupole magnetic field has a zero field line along the symmetry axis and the magnetic field remains on continuously during an experiment while maintaining a ground state coherence time of up to 5 μs.

13. The dark-line two-dimensional magneto-optical trap device of claim 8, wherein said two-dimensional quadrupole magnetic field has a zero field line along the symmetry axis and turning off the magnetic field results in obtaining a ground state coherence time of more than 5 μs.

14. A method to produce a repumping laser dark line on the center of a dark-line two-dimensional magneto-optical trap (MOT), comprising:

using a lens imaging system to image an opaque line to the longitudinal axis of the two dimensional magneto optical trap in each repumping beam.

15. The method of claim 14, wherein the overlap of the two line images creates a dark line volume in the longitudinal axis exhibiting an absence of repumping light.

* * * * *